US008542858B2

(12) United States Patent
Flaig et al.

(10) Patent No.: US 8,542,858 B2
(45) Date of Patent: Sep. 24, 2013

(54) HEARING DEVICE WITH A SPACE-SAVING ARRANGEMENT OF MICROPHONES AND SOUND OPENINGS

(75) Inventors: Uwe Flaig, Feucht (DE); Volker Gebhardt, Neunkirchen am Brand (DE); Holger Kral, Fürth (DE); Dietmar Lommel, Poxdorf (DE); Herve Schulz, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 327 days.

(21) Appl. No.: 12/959,787

(22) Filed: Dec. 3, 2010

(65) Prior Publication Data

US 2011/0135127 A1 Jun. 9, 2011

(30) Foreign Application Priority Data

Dec. 3, 2009 (DE) ..... 10 2009 056 916

(51) Int. Cl.
*H04R 25/00* (2006.01)

(52) U.S. Cl.
USPC ..... 381/358; 381/313; 381/330

(58) Field of Classification Search
USPC ..... 381/313, 322, 324, 330, 355–360
See application file for complete search history.

(56) References Cited

U.S. PATENT DOCUMENTS

| | | | | |
|---|---|---|---|---|
| 3,835,263 | A * | 9/1974 | Killion | 381/313 |
| 4,051,330 | A * | 9/1977 | Cole | 381/313 |
| 4,142,072 | A * | 2/1979 | Berland | 381/313 |
| 6,690,806 | B1 * | 2/2004 | Darbut et al. | 381/313 |
| 6,876,749 | B1 * | 4/2005 | Killion et al. | 381/122 |
| 7,245,728 | B2 * | 7/2007 | Killion et al. | 381/122 |
| 7,881,486 | B1 * | 2/2011 | Killion et al. | 381/313 |
| 2003/0198359 | A1 * | 10/2003 | Killion et al. | 381/313 |
| 2008/0212817 | A1 | 9/2008 | Lommel et al. | |
| 2010/0260366 | A1 | 10/2010 | Heerlein et al. | |

FOREIGN PATENT DOCUMENTS

| | | | |
|---|---|---|---|
| DE | 102007010014 | A1 | 9/2008 |
| DE | 10 2008 018 041 | A1 | 10/2009 |
| DE | 102008037025 | A1 | 2/2010 |
| WO | 2010015298 | A2 | 2/2010 |

* cited by examiner

*Primary Examiner* — Mohammad Islam
*Assistant Examiner* — Phylesha Dabney
(74) *Attorney, Agent, or Firm* — Laurence A. Greenberg; Werner H. Stemer; Ralph E. Locher

(57) ABSTRACT

A behind-the-ear hearing device has a hearing device housing and a user-operable switch. At least two microphones are disposed below the switch in the hearing device housing, and the housing is formed with first sound openings that are arranged directly below the switch. The switch is preferably a rocker switch. The microphones can be positioned below a switch in a space-saving fashion and the installation space of the hearing device housing can thus be used optimally.

11 Claims, 5 Drawing Sheets

HEARING DEVICE WITH A SPACE-SAVING ARRANGEMENT OF MICROPHONES AND SOUND OPENINGS

CROSS-REFERENCE TO RELATED APPLICATION

This application claims the priority, under 35 U.S.C. §119, of German patent application DE 10 2009 056 916.2, filed Dec. 3, 2009; the prior application is herewith incorporated by reference in its entirety.

BACKGROUND OF THE INVENTION

Field of the Invention

The invention lies in the hearing device field and relates, more specifically, to a behind-the-ear hearing device having a hearing device housing and a switch, which can be operated from the outside of the hearing device housing. The switch is a rocker switch for instance.

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver and in-the-ear (ITE) hearing devices, for example also concha hearing devices or completely-in-the-canal (CIC) hearing devices. The hearing devices listed as examples are worn on the outer ear or in the auditory canal. Bone conduction hearing aids, implantable or vibrotactile hearing aids are also available on the market. It is possible, therefore, to stimulate the damaged hearing mechanically or electrically.

The major components of hearing devices are principally an input converter, an amplifier and an output converter. The input converter is normally a receiving transducer, such as a microphone and/or an electromagnetic receiver, such as an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device 1. Two microphones 3 for recording ambient sound are built into a hearing device housing 2 to be worn behind the ear. Microphone openings 7 in the hearing device housing 2 are embodied above the microphone 3. Sound can reach the microphones 3 inside the hearing device housing through the sound openings 7. A signal processing unit 4 (SPU) which is also integrated into the hearing device housing 2 processes and amplifies the microphone signals. The output signal for the signal processing unit 4 is transmitted to a loudspeaker or receiver 5, which outputs an acoustic signal. Sound is transmitted through a non-illustrated sound tube, which is affixed in the auditory canal by means of an otoplastic, to the device wearer's eardrum. Power for the hearing device 1 and in particular for the signal processing unit 4 is supplied by way of a battery 6 which is also integrated in the hearing device housing 1.

Commonly assigned patent application publication US 2010/0260366 A1 and its counterpart German application DE 10 2008 018 041 A1 disclose a behind-the-ear hearing device of this type having a microphone opening, with a volume controller, a programmer socket, a program button with an off function, and a battery compartment.

SUMMARY OF THE INVENTION

It is accordingly an object of the invention to provide a behind-the-ear hearing device which overcomes a variety of the disadvantages of the heretofore-known devices and methods of this general type and wherein the provision of a larger switch, for instance a rocker switch, does not necessarily result in an enlargement of the hearing device housing.

With the foregoing and other objects in view there is provided, in accordance with the invention, a behind-the-ear hearing device, comprising:

a hearing device housing;

a switch partially disposed within the hearing device housing;

at least two microphones disposed in the hearing device housing underneath said switch; and sound openings formed in the hearing device housing underneath the switch.

In other words, the objects of the invention are achieved by way of a behind-the-ear hearing device having a hearing device housing and a switch. The switch is partially located within the hearing device housing. The arrangement also includes at least two microphones, which are arranged below the switch in the hearing device housing, and first sound openings in the hearing device housing, which are arranged below the switch and are concealed thereby. The invention is advantageous in that microphones can be positioned below a switch in a space-saving fashion and the installation space of the hearing device housing can thus be used optimally.

In a development of the invention, the hearing device can include second sound openings in the switch. Ambient sound can advantageously reach the first sound openings through the second sound openings.

In a further embodiment, the hearing device includes third sound openings in the hearing device housing adjacent the switch. Ambient sound can advantageously reach the first sound openings through the third sound openings.

Furthermore, the first sound openings can be arranged such that ambient sound can reach the microphones through the first sound openings.

The switch can advantageously be a rocker switch, which is arranged in the longitudinal direction of the hearing device housing. With the aid of rocker switches, the direction of the switching movements can be simply and reliably changed.

In a development of the invention, the rocker switch can comprise four second sound openings, which are arranged in pairs on the left and right sides of the rocker switch. The ambient sound advantageously reaches a cavity of the rocker switch through said openings.

In a further embodiment, the microphones can comprise microphone protection systems, which are arranged directly below the first sound openings.

With the above and other objects in view there is also provided, in according to the invention, a behind-the-ear hearing device having a hearing device housing and a switch, which is partially arranged within the hearing device housing, with at least two microphones being arranged below the switch in the hearing device housing. The hearing device housing comprises (fourth) sound openings, which are arranged adjacent to the switch such that ambient sound can reach the microphones through the fourth sound openings.

In similarity to the first-mentioned embodiment, the switch may be a rocker switch, which is arranged in the longitudinal direction of the hearing device housing.

In accordance with a concomitant feature of the invention, the hearing device housing can comprise four such sound openings, which are arranged in pairs to the left and right in the longitudinal direction of the rocker switch.

Other features which are considered as characteristic for the invention are set forth in the appended claims.

Although the invention is illustrated and described herein as embodied in a hearing device with a space-saving arrangement of microphones and sound openings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
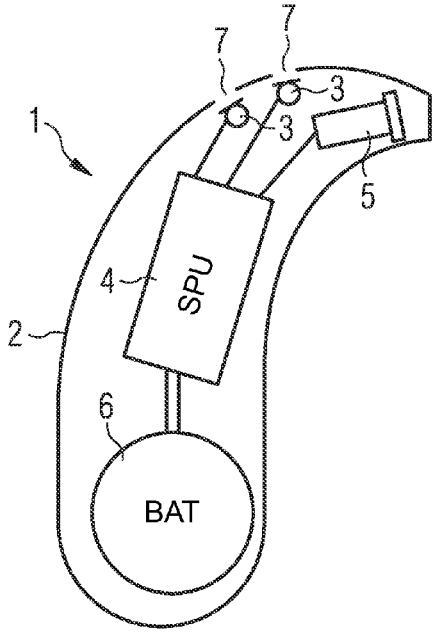
FIG 1 PRIOR ART
FIG. 1 shows a behind-the-ear hearing device according to the prior art.
Figure 2:
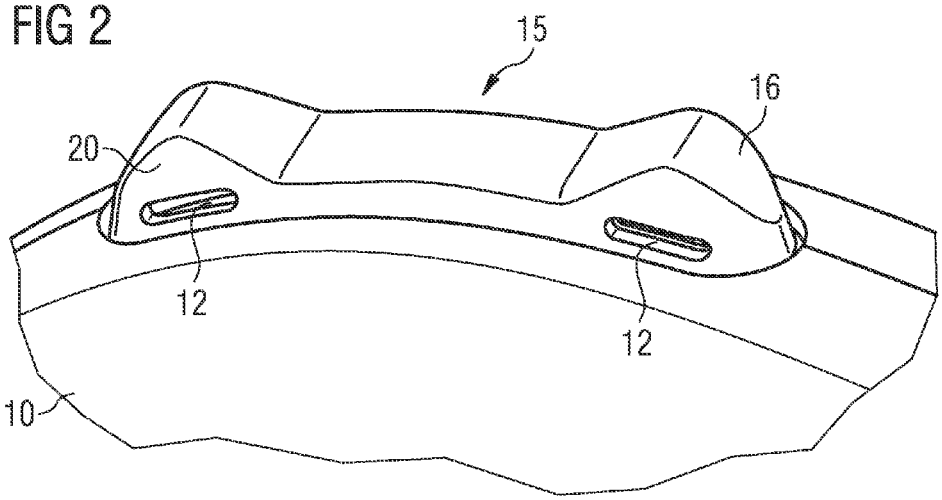
FIG. 2 shows an oblique view of part of a behind-the-ear hearing device housing having a rocker switch and sound openings in the rocker switch.
Figure 3:
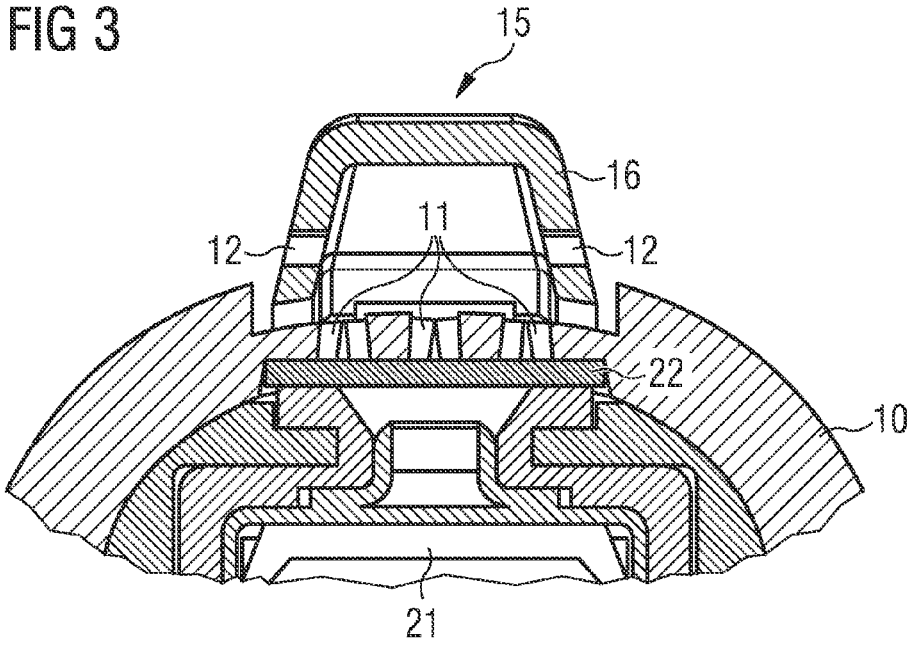
FIG. 3 shows a sectional view of the hearing device housing having a rocker switch shown in FIG. 2.
Figure 4:
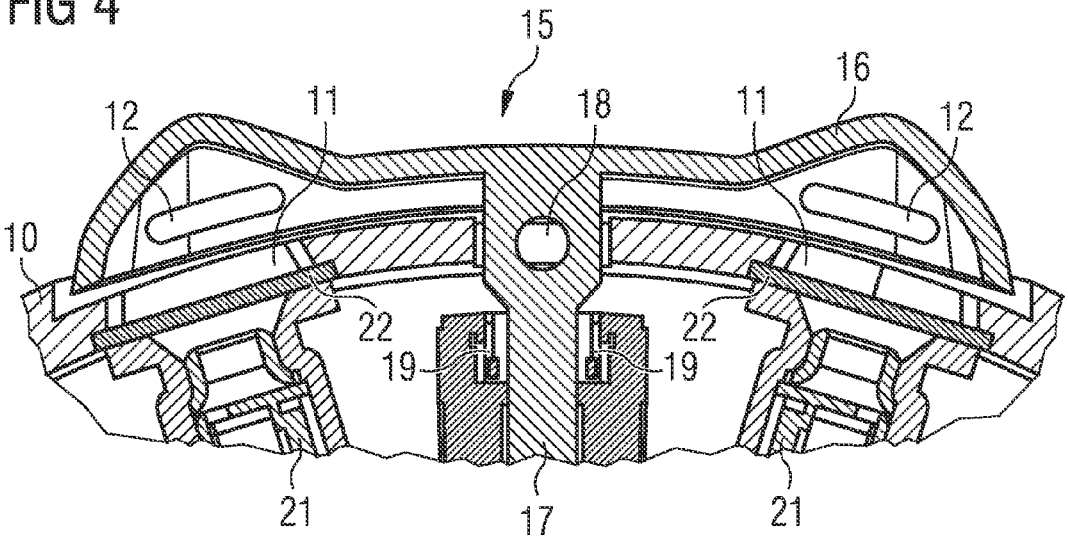
FIG. 4 shows a further sectional view of the hearing device housing having a rocker switch shown in FIG. 2.

Referring now once more to the figures of the drawing in detail, and particularly to FIGS. 2 to 4 thereof, there is shown an exemplary embodiment of a behind-the-ear hearing device according to the invention. Here, ambient sound can reach openings in the hearing device housing of the hearing device that are disposed below the rocker through openings in a rocker. The ambient sound finally reaches microphones mounted below the rocker in the hearing device housing through the openings in the hearing device housing.

FIG. 2 shows an oblique view of part of a hearing device housing 10 of a behind-the-ear hearing device and a rocker switch 15. The rocker 16 of the rocker switch 15 is visible, said rocker being moveable in order to actuate the switching contacts. In the visible side 20 of the rocker 16, two second sound openings 12 are recessed, through which the ambient sound can reach into a non visible cavity of the rocker switch 15 below the rocker 16. Second sound openings 12 are likewise arranged on the non visible opposite sides of the rocker 16 in symmetry with the two visible second sound openings 12.

FIG. 3 shows a cross-section through a part of a hearing device housing 10 and through a rocker switch 15. The rocker 16 of the rocker switch 15 comprises second sound openings 12, through which the ambient sound reaches a cavity of the rocker 16. A microphone 21 is arranged in the hearing device housing 10. Above a microphone protection system 22 of the microphone 21, the hearing device housing 10 comprises several first sound openings 11, through which the ambient sound can reach the microphone 21 from the cavity of the rocker 16.

FIG. 4 shows a longitudinal section through a part of a hearing device housing 10 and through a rocker switch 15. Two microphones 21 are mounted below the rocker switch 15 in the hearing device housing 10. First sound openings 11 are disposed above the microphone protection systems 22 of the microphone 21. The rocker switch 15 includes a rocker 16, a switching tongue 17 and a swivel 18, with which the rocker switch 15 is rotatably mounted to a limited degree. The switching tongue 17 enables two buttons 19 arranged in the hearing device housing 10 to be actuated. The rocker switch 15 therefore effects a 90° change in direction of a switching movement. The rocker 16 comprises second sound openings 12 on its sides above the microphone 21. The ambient sound reaches the first sound openings 11 and the microphone protection systems 22 of the microphone 21 herethrough.

Figure 5:
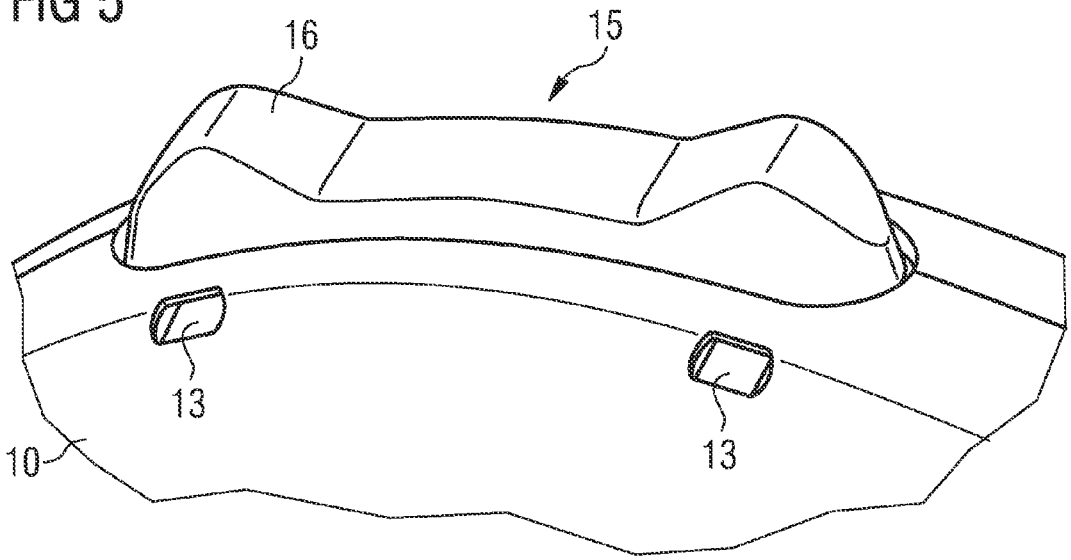
FIG. 5 shows an oblique view of part of a further behind-the-ear hearing device housing having a rocker switch and sound openings in the hearing device housing.
Figure 6:
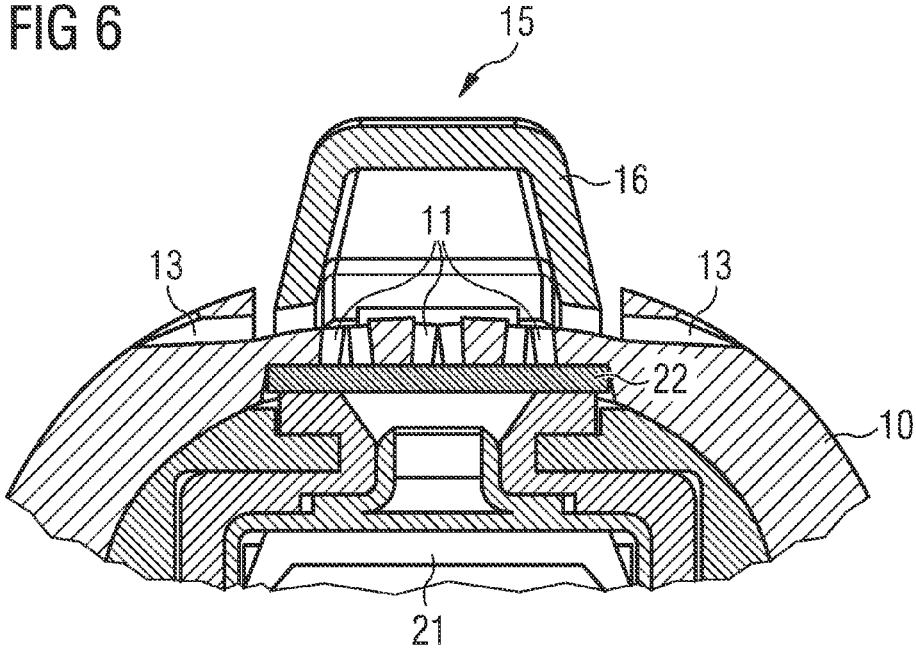
FIG. 6 shows a sectional view of the hearing device housing having a rocker switch shown in FIG. 5.
Figure 7:
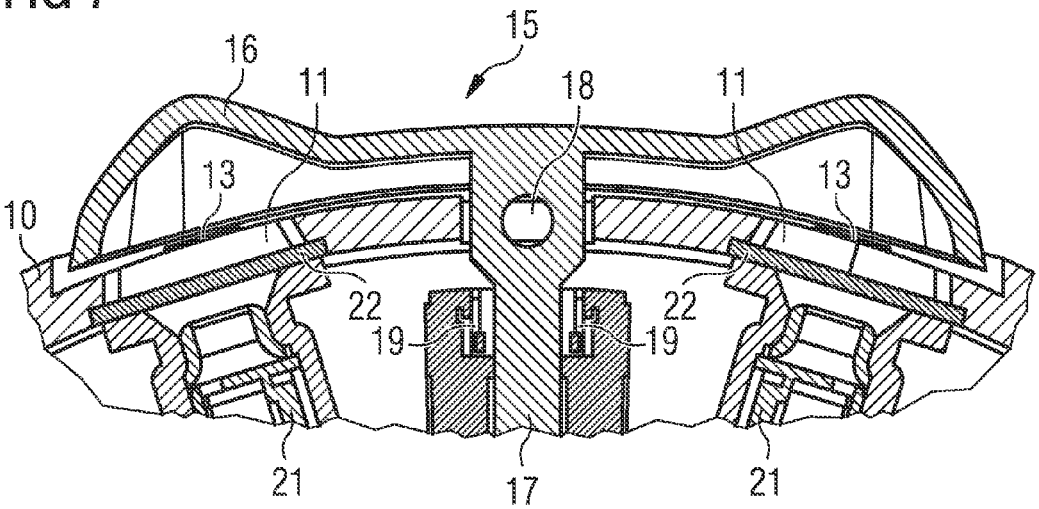
FIG. 7 shows a further sectional view of the hearing device housing having a rocker switch shown in FIG. 5.

FIGS. 5 to 7 show a further inventive exemplary embodiment of a behind-the-ear hearing device, in which an ambient sound can reach openings in the hearing device housing which are disposed below a rocker through openings arranged laterally in a hearing device housing of the hearing device. The ambient sound finally reaches microphones mounted below the rocker in the hearing device housing through these openings in the hearing device housing.

FIG. 5 shows an oblique view of part of a hearing device housing 10 of a behind-the-ear hearing device and a rocker switch 15. The rocker 16 of the rocker switch 15 is visible, said rocker being moveable in order to actuate the switching contacts. In the visible side of the hearing device housing 10, two third sound openings 13 are recessed below the rocker 16, through which the ambient sound can reach into a non-visible cavity in the rocker 16. Third sound openings 13 are likewise arranged on the non visible opposite side of the hearing device housing 10 in symmetry with the two visible third sound openings 13.

FIG. 6 shows a cross-section through a part of a hearing device housing 10 and through a rocker switch 15. The hearing device housing 10 comprises third sound openings 13 to the left and right of the rocker switch 15, through which sound openings 13 the ambient sound reaches a cavity of the rocker 16 of the rocker switch 15. A microphone 21 is arranged in the hearing device housing 10 below the rocker 16. Above a microphone protection system 22 of the microphone 21, the hearing device housing 10 comprises several first sound openings 11, through which the ambient sound can reach the microphone 21 from the cavity of the rocker 16.

FIG. 7 shows a longitudinal section through a part of a hearing device housing 10 and through a rocker switch 15. Two microphones 21 are arranged below the rocker switch 15 in the hearing device housing 10. First sound openings 11 in the hearing device housing 10 are disposed above the microphone protection systems 22 of the microphone 21. The rocker switch 15 includes a rocker 16, a switching tongue 17 and a swivel 18, with which the rocker switch 15 is rotatably mounted to a limited degree. The switching tongue 17 enables two buttons 19 arranged in the hearing device housing 10 to be actuated. The rocker switch 15 therefore effects a 90° change in direction of a switching movement. The hearing device housing 10 comprises third sound openings 13 on its sides above the microphone 21. The ambient sound reaches the first sound openings 11 herethrough and the microphone protection systems 22 of the microphone 21 therethrough.

Figure 8:
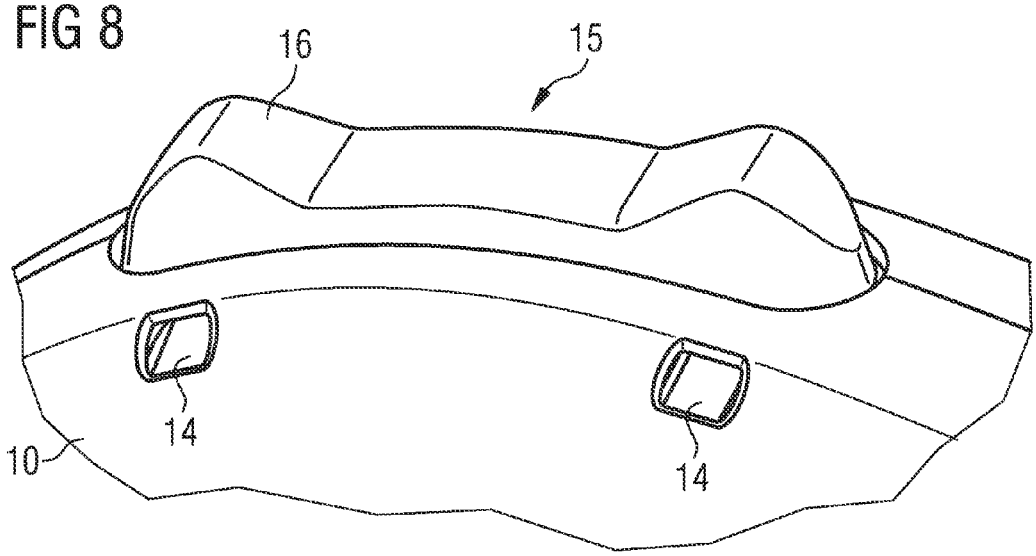
FIG. 8 shows an oblique view of part of a further behind-the-ear hearing device housing having a rocker switch and sound openings in the hearing device housing.
Figure 9:
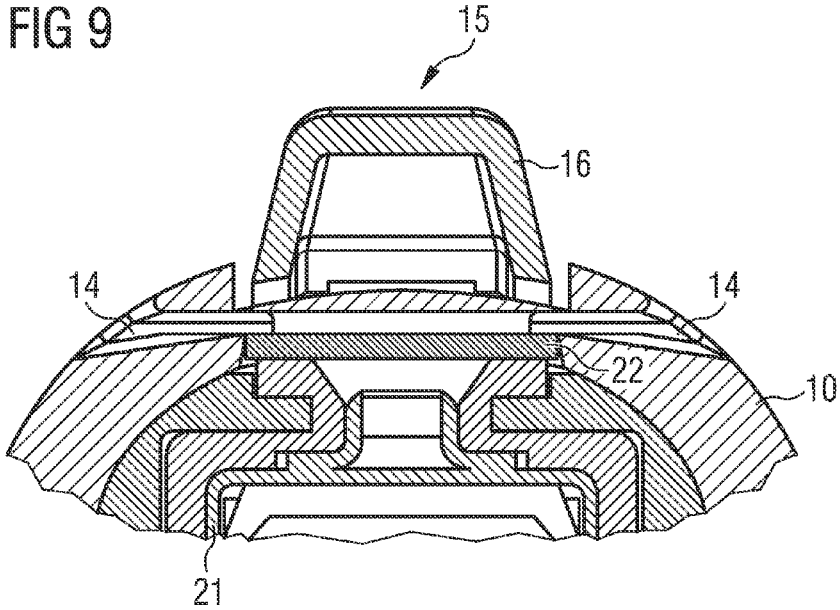
FIG. 9 shows a sectional view of the hearing device housing having a rocker switch shown in FIG. 8.
Figure 10:
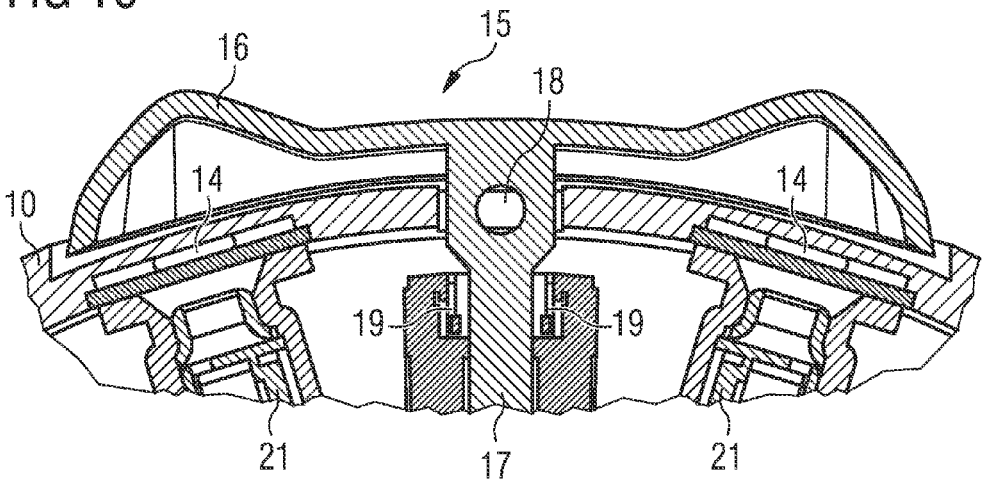
FIG. 10 shows a further sectional view of the hearing device housing having a rocker switch shown in FIG. 8.

FIGS. 8 to 10 show a further inventive exemplary embodiment of a behind-the-ear hearing device, in which an ambient sound can reach microphones in the hearing device housing, which are disposed below a rocker, through openings disposed laterally in a hearing device housing of the hearing device.

FIG. 8 shows an oblique view of part of a hearing device housing 10 of a behind-the-ear hearing device and a rocker switch 15. The rocker 16 of the rocker switch 15 is visible, said rocker being moveable in order to actuate the switching contacts. In the visible side 10 of the hearing device housing 10, two fourth sound openings 14 are recessed below the rocker 16, through which the ambient sound can reach a non visible microphone disposed below the rocker 16. Fourth sound openings 14 are likewise arranged on the non visible opposite side of the hearing device housing 10 in symmetry with the two visible fourth sound openings 14.

FIG. 9 shows a cross-section through a part of a hearing device housing 10 and through a rocker switch 15. The hearing device housing 10 comprises fourth sound openings 14 to the left and right of the rocker switch 15, through which sound openings 13 the ambient sound reaches a microphone protection system 22 of a microphone 21. The microphone 21 is mounted in the hearing device housing 10 below the rocker 16 of the rocker switch 15.

FIG. 10 shows a longitudinal section through a part of a hearing device housing 10 and through a rocker switch 15. Two microphones 21 are arranged below the rocker switch 15 in the hearing device housing 10. The rocker switch 15 includes a rocker 16, a switching tongue 17 and a swivel 18, with which the rocker switch 15 is rotatably mounted to a limited degree. The switching tongue 17 enables two buttons 19 arranged in the hearing device housing 10 to be actuated. The rocker switch 15 therefore effects a 90° change in direction of a switching movement. The hearing device housing 10 comprises fourth sound openings 14 on its sides at the height of the microphone protection system 22 of the microphone 21. The ambient sound reaches the microphone protection systems 22 of the microphone 21 therethrough.

Instead of a rocker switch, other types of switches, such as, for instance a sliding switch, can also be used.

It will be understood that the hearing device housing 10 may be embodied in several parts from shells.

The invention claimed is:

1. A behind-the-ear hearing device, comprising:

a hearing device housing;

a switch partially disposed within said hearing device housing;

at least two microphones disposed in said hearing device housing underneath said switch; and said hearing device housing having sound openings formed therein underneath said switch.

2. The hearing device according to claim 1, wherein said sound openings formed in said hearing device housing are first sound openings, and said switch is formed with second sound openings, and wherein said second sound openings are arranged such that ambient sound is able to reach said first sound openings through said second sound openings.

3. The hearing device according to claim 2, wherein said hearing device housing is formed with third sound openings arranged adjacent said switch, enabling ambient sound to reach said first sound openings through said third sound openings.

4. The hearing device according to claim 3, wherein said first sound openings are disposed to enable ambient sound to reach said microphones through said first sound openings.

5. The hearing device according to claim 1, wherein said hearing device housing is formed with further sound openings adjacent said switch, enabling ambient sound to reach said sound openings formed underneath said switch through said further sound openings.

6. The hearing device according to claim 1, wherein said switch is a rocker switch aligned along a longitudinal direction of said hearing device housing.

7. The hearing device according to claim 6, wherein said rocker switch is formed with four second sound openings, disposed in pairs to a left side and a right side of said rocker switch.

8. The hearing device according to claim 1, which further comprises a microphone protection system for protecting said microphones that are arranged directly below said first sound openings.

9. A behind-the-ear hearing device, comprising:

a hearing device housing formed as a behind-the-ear hearing device housing to be worn behind the ear;

a switch partially disposed within said hearing device housing;

at least two microphones in said hearing device housing and disposed underneath said switch; and said hearing device housing having sound openings formed therein adjacent said switch to enable ambient sound to reach said microphones through said sound openings.

10. The hearing device according to claim 9, wherein said switch is a rocker switch disposed in alignment along a longitudinal direction of said hearing device housing.

11. The hearing device according to claim 10, wherein said rocker switch is formed with four sound openings, disposed in pairs to a left side and a right side of said rocker switch.

* * * * *